United States Patent [19]

Donohoe

[11] Patent Number: 4,798,121

[45] Date of Patent: Jan. 17, 1989

[54] IMPACT RESISTANT DRUMHEAD

[75] Inventor: David G. Donohoe, Springville, Calif.

[73] Assignee: Aquarian Accessories Corporation, Anaheim, Calif.

[21] Appl. No.: 54,840

[22] Filed: May 27, 1987

[51] Int. Cl.[4] ..... G10D 13/02

[52] U.S. Cl. ..... 84/414

[58] Field of Search ..... 84/414

[56] References Cited

U.S. PATENT DOCUMENTS

| | | | |
|---|---|---|---|
| 729,936 | 6/1903 | Heybeck | 84/414 |
| 1,018,767 | 2/1912 | Logan | 84/414 |
| 4,308,782 | 1/1982 | Hartry | 84/414 |

FOREIGN PATENT DOCUMENTS

| | | | |
|---|---|---|---|
| 1583781 | 2/1981 | United Kingdom | 84/414 |

*Primary Examiner*—Lawrence R. Franklin

*Attorney, Agent, or Firm*—William L. Chapin

[57] ABSTRACT

A drumhead for percussion instruments having improved resistance against denting and damaging by drumstick impact includes a synthetic plastic film base sheet and a protective overlay adhered to the upper, impact surface of the base sheet. The protective overlay consists of two thin sheets of woven synthetic plastic cloth which are bonded together with their woof directions at right angles to form a cross-laminated overlay, which is bonded to the upper surface of the base sheet. In the preferred embodiment, the cross-laminated overlay consists of two circular discs of woven polyester fabric bonded together. Preferably, the upper surface of the upper disc is coated with a synthetic plastic material such as a vinyl compound to provide a crisp attack sound when impacted by a drumstick. The overlay is bonded to the upper central surface of the base sheet, providing an impact resistant surface while not degrading the overall sound quality of the drumhead.

27 Claims, 1 Drawing Sheet

IMPACT RESISTANT DRUMHEAD

BACKGROUND OF THE INVENTION

A. Field of the Invention

The present invention relates to drumheads for drums or similar musical instruments. More particularly, the invention relates to an improved drumhead having increased resistance to denting or damage by drumstick impact.

B. Discussion of Background Art

Drums are perhaps one of the most ancient types of musical instruments. They constitute an essential element in most classical and modern musical ensembles.

Originally, drumheads were made almost exclusively of animal skins, such as calfskin. Modernly, drumheads are fabricated from thin sheets of synthetic plastic. That material was substituted for natural animal skins in an effort to make possible the production of large volumes of drumheads of uniform qualities and lower cost than the natural materials, and to avoid some of the more undesirable qualities of natural drumheads, such as moisture absorbitivity.

Replacement of animal skin drumheads by those made from synthetic plastic sheets was not without disadvantages. For example, polyester films were found to be one of the strongest and most desirable synthetic drumhead materials, yet still possessing inherent limitations limiting the usefulness of that material.

One type of saturated-thermoplastic type polyester film which has been used extensively as a synthetic drumhead material is the condensation polymer of ethlyene glycol and terephthalic acid which has been formed into a thin film by biaxial stretching. Such polyester films are available commercially from the E. I. Dupont de Nemours & Co., Inc., under the trademark MYLAR. This material has high strength, good weatherability, and reasonable tonal qualities. And yet, while such polyester film is one of the strongest available synthetic drumhead materials, it is subject to denting or tearing in response to drumstick impact. Thus, the useful life of a polyester film drumhead in some relatively severe applications, such as "Rock" bands, can be as short as one hour or less.

Because of the cost and inconvenience associated with frequent replacement of dented or torn drumheads made of polyester film, various means have been tried to minimize the damage to the drumheads by drumstick impact. For example, Hartry, in U.S. Pat. No. 4,308,782, Jan. 5, 1982, discloses a drumhead in which a randomly oriented synthetic fabric material is laminated to the upper, impact surface of polyester film to form a laminated drumhead which is stated to have a reduced tendency to dent. U.S. Pat. No. 4,362,081, Dec. 7, 1982, also issued to Hartry, discloses a laminated drumhead in which polyester films are adhered to either side of a synthetic fabric material woven from a fiber yarn. The fabric material is stated to be the primary tension load carrier, and thereby to reduce the incidents of drumhead fracture.

In both of the above-identified patents, the entire drumhead is laminated with the specified materials, producing a sound quality substantially different from that achievable with an un-laminated polyester film.

Other attempts have been made to improve the impact resistance and useful life of polyester film drumheads. These include the lamination of a thin disc of vinyl, typically 0.006 inch thick, with a 0.0015 inch thick cover of polyester film, to the center of a drumhead made of polyester film. In our tests of drumheads so fabricated, we have found that the thin polyester film top lamination layer wears away and peels away after a relatively short playing time. Since vinyl is a very soft plastic, once the thin, harder polyester film layer wears away, impact of drumsticks quickly wears away the underlying polyester film. Thus, whatever resistance to drumhead or tearing might be afforded by this method of drumhead construction is very short lived. Moreover, the combination of polyester film and vinyl film in a laminated disc inhibits the natural frequency response of the drumhead. The result is a muffled mixture of unpleasing sound frequencies.

Another drumhead construction used in an effort to extend drumhead life consists of a disc of 0.007 inch-thick solid polyester film laminated to the upper center portion of a polyester film drumhead. In our tests of drumheads so construction, we found that after a short playing time, the overlying polyester film disc cracked and dented, offering little or no protection to the drumhead from denting or breaking. Moreover, the thickness of the polyester film lamina reduced the volume and frequency response of the drumhead. The present invention was conceived of to provide improved drumhead performance while avoiding some of the limitations of prior art drumhead strengthening modifications.

OBJECT OF THE INVENTION

An object of the present invention is to provide an improved drumhead construction in which the drumhead is protected against denting and breaking by drumstick impact.

Another object of the invention is to provide an improved drumhead construction which has greater useful life but without degrading the sound volume r frequency response of the drumhead.

Another object of the invention is to provide an improved drumhead construction having improved resistance to drumstick damage while maintaining a sharp, clear impact sound.

Various other objects and advantages of the present invention, and its most novel features, will be particularly pointed out in this disclosure.

It is to be understood that although the invention disclosed herein is fully capable of achieving the objects and providing the advantages mentioned, the structural and operational characteristics of the invention described herein are merely illustrative of the preferred embodiments. Accordingly, I do not intend that the scope of my exclusive rights and privileges in the invention be limited to the details of construction and operation described. I do intend that reasonable equivalents, adaptations and modifications of the invention described herein be included within the scope of the invention as defined by the appended claims.

SUMMARY OF THE INVENTION

Briefly stated, the present invention comprehends an improved drumhead construction of superior impact resistance which employs an overlay consisting of two sheets or lamina of woven synthetic plastic fibers, which are coated with a synthetic plastic material. The two sheets are cross-laminated together with their woof directions perpendicular to one another, and then fastened to the upper surface of a central region of a drumhead made of plastic film, thereby increasing the impact resistance on the drumhead. The plastic coating on the upper surface of the upper lamina enhances impact resistance, and also results in a crisp impact sound when struck by a drumstick.

DETAILED DESCRIPTION OF THE INVENTION

Figure 1:
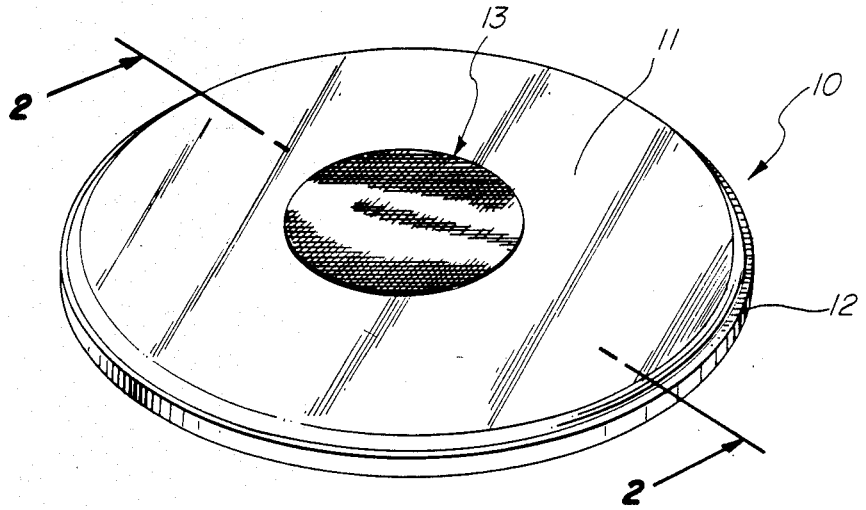
FIG. 1 is a perspective view of the improved drumhead construction according to the present invention.

FIG. 1 illustrates a drumhead 10 with an improved impact-resistant construction according to the present invention. As shown in FIG. 1, the drumhead 10 includes a circular sheet 11 of thin, flexible material fastened at its outer circumference to a rigid circular ring or hoop 12 adapted to fit over an open end of a cylindrical drum or similar musical instrument.

The circular sheet 11 comprising the main portion of the drumhead 10 may be fabricated from a variety of materials.

These include natural materials, such as calfskin, or synthetic materials, such as polyester film. The preferred material for the drumhead sheet 11 according to the present invention is a condensation polymer of ethylene glycol and terephthalic acid which has been formed into a film approximately 0.010 inch thick by biaxial stretching. This film material is available commercially from the E.I. Dupont de Nemours & Co., Inc., under the trademark MYLAR.

The construction of the drumhead 10 as described so far is in accordance with conventional prior-art construction methodology. The novel construction of drumhead 10 according to the present invention includes the addition of a laminated overlay 13.

As shown in FIG. 1, the laminated overlay 13 is attached to the upper surface of the center portion of the drumhead sheet 11. Also as shown in FIG. 1, the laminated overlay 13 is preferably circular shaped, and has a preferred diameter of approximately one-third the diameter of the drumhead it is to be understood that other shapes, sheet 11. Of course, sizes and locations of the laminated overlay 13 fastened to the upper surface of the drumhead sheet 11 could be employed without departing from the novel and advantageous features of the drumhead construction according to the present invention, as set forth in detail below.

Figure 2:
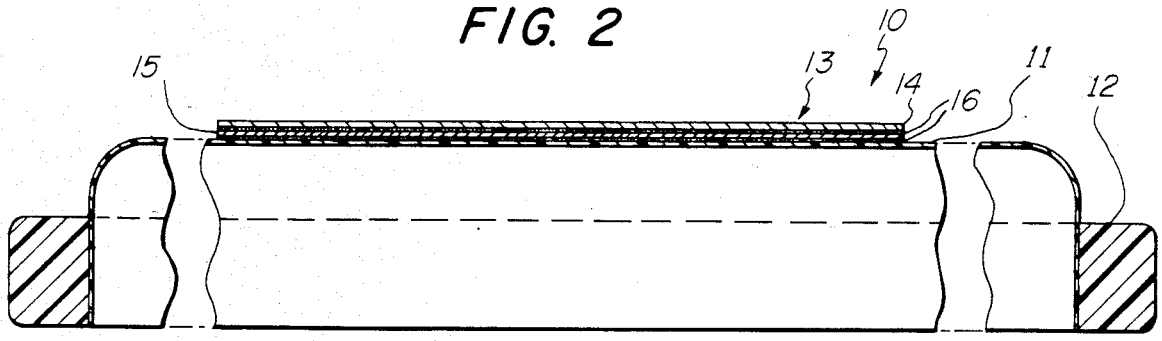
FIG. 2 is a cross-sectional view of the drumhead of FIG. 1, taken along line 2—2.
Figure 3:
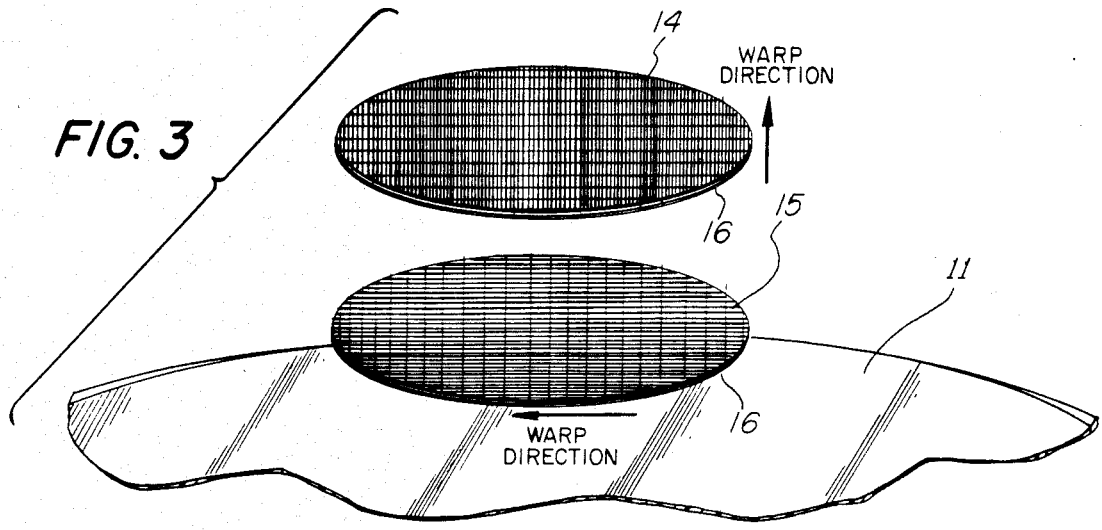
FIG. 3 is an exploded, fragmentary view of the drumhead of FIG. 2, showing how an overlay portion thereof is fabricated.

As shown in more detail in FIGS. 2 and 3, the laminated overlay disc 13 comprises two layers or lamina; an upper lamina 14 and a lower lamina 15. Both upper lamina 14 and lower lamina 15 of overlay disc 13 are fabricated from the same material, namely, a cloth or fabric woven of synthetic plastic fibers, and then coated or impregnated with plastic.

An important feature of the present invention is the orientation of the fabric strands in the upper lamina 14 relative to those of the lower lamina 15 of the laminated overlay disc 13. In the weaving of fabric, fibers stretched taughtly in a lengthwise direction, parallel to the processing or rolling direction of fabrication, are called the warp. Threads taken together which run from side to side are commonly called the woof, or more correctly, the weft. Usually, woven fabrics have substantially different tensile strength and tear resistance in the warp and woof directions. Typically, a woven fabric has substantially greater tensile strength and resistance to tearing for forces applied perpendicular to the warp direction and parallel to the woof direction.

In the laminated overlay disc 13 of the present invention, the upper lamina 14 and lower lamina 15 are oriented with their warp directions perpendicular to one another. This cross-laminated disc 13 provides a protective overlay for the drumhead sheet 11 which is effective for various striking angles of a drumstick on the drumhead 10. In a preferred construction of the overlay disc 13 according to the present invention, plastic woven cloth of 0.006 inch thickness and available under the trademark FLEXMARK PC 600-W from the Flexcon Corporation, Flexcon Industrial Park Rd., Spencer, Mass. 01562, was used to fabricate upper lamina 14 and lower lamina 15. That material has a weight of approximately 2.8 oz. per square yard, and is applied with a pressure sensitive adhesive layer 16 on one surface. Various woven and impregnated plastic fabrics are considered to be useful in the fabrication of the laminated overlay disc 13 according to the present invention, as long as the respective layers 14 and 15 are cross-laminated. These include synthetic plastic fabrics woven of polyester fibers and impregnated with polyvinyl chloride resin.

Various pressure-sensitive adhesives such as acrylic adhesives are usable in the drumhead construction according to the present invention, both to adhere the upper lamina 14 of overlay disc 13 to lower lamina 15, and to adhere lower lamina 15 to the upper surface of the drumhead sheet 11. The drumhead 10 in which upper lamina 15 have been cross-laminated, or adhered together with their warp directions perpendicular to one another, and the overlay disc 13 so constructed and adhered to the upper surface of the drumhead sheet 11, has important advantages over prior drumheads which will now be pointed out.

The cross-laminated overlay disc 13 according to the present invention protects the drumhead sheet 11 against denting from drumstick impact. The two layers of woven fibers provide a biaxial stretch resistance, and therefore protect the center area of the drumhead sheet from denting, damage, and resultant shortened life. In contrast to non-woven materials, or woven materials not cross-laminated according to the teachings of the present invention, the overlay disc according to the present invention does not fatigue, crack or tear under the impact of drumsticks, and therefore protects the drumhead sheet from breaking.

The drumhead construction using a cross-laminated overlay according to the present invention provides a greatly increased ion, the plastic-coated woven fabric has a relatively hard surface, resulting in a clear, sharp impact or attack sound when struck by a drumstick. Also, the light weight of the cross-laminated overlay made of flexible, woven fabric does not adversely affect the volume output or frequency response of the drumhead. Thus, the present invention provides a novel drumhead construction of enhanced life and highly satisfactory acoustic performance.

What is claimed is:

1. A head for drums and related percussion instruments comprising:

(a) a circular base sheet, (b) a first, lower overlay sheet of woven synthetic plastic material, said overlay sheet having a circular shape of substantially smaller diameter than said base sheet and adhered to the upper impact surface of said base sheet at the geometric center thereof, and (c) a second, upper overlay sheet of woven synthetic plastic material, said upper overlay adhered concentrically within the perimeter of said lower overlay sheet in a cross-laminated relationship to said lower overlay sheet, with the woof directions of said first and second overlay sheets oriented at an angle with respect to one another.

2. The head of claim 1 wherein said orientation angle between the woof directions of said first and second overlay sheets is substantially ninety degrees.

3. The head of claim 2 wherein at least one of said first and second overlay sheets is coated with a synthetic plastic material.

4. The head of claim 2 wherein said first and second overlay sheets are fabricated from woven polyester fibers.

5. The head of claim 4 wherein at least one of said woven polyester overlay sheets has at least one surface coated with a synthetic plastic material.

6. The head of claim 4 wherein the upper surface of said second, upper overlay sheet is coated with a synthetic plastic material.

7. The head of claim 6 wherein said plastic material coating the upper surface of said second, upper overlay sheet is further defined as being a vinyl compound.

8. The head of claim 7 wherein said plastic coating is further defined as being polyvinyl chloride.

9. The head of claim 1 wherein said base sheet is fabricated from a biaxially stretched, synthetic plastic film.

10. The head of claim 9 wherein said synthetic plastic film is further defined as being composed of a condensation polymer of ethylene glycol and terephthalic acid.

11. A head for drums and related percussion instruments comprising;

(a) a circular base sheet, (b) a first, lower overlay sheet of woven synthetic plastic material, said overlay sheet having a circular shape of substantially smaller diameter than said base sheet and adhered to the upper, impact surface of said base sheet in flat, parallel overlying relationship thereto, and (c) at least one second, upper overlay sheet of woven synthetic plastic material, said upper overlay sheet being adhered concentrically within the perimeter of said lower overlay sheet to the upper surface of the said overlay sheet beneath it in flat, parallel overlying relationship thereto.

12. The head of claim 11 wherein the woof directions of each of said overlay sheets are oriented at an angle with respect to one another.

13. The head of claim 11 wherein the woof directions of said first and second overlay sheets are oriented at ninety degrees with respect to one another.

14. The head of claim 13 wherein said first, lower overlay sheet is adhesively bonded to the upper, impact surface of said base sheet.

15. The head of claim 14 wherein said second, upper overlay sheet is adhesively bonded to the upper surface of said first, lower overlay sheet beneath it.

16. The head of claim 15 wherein the upper surface of the uppermost of said second, upper overlay sheet is coated with a plastic material.

17. The head of claim 16 wherein said plastic material coating the upper surface of the uppermost of said second, upper overlay sheets is further defined as being a vinyl compound.

18. A head for drums and related percussion instruments comprising:

(a) a circular base sheet, (b) a first, lower overlay sheet of thin, woven synthetic plastic material, said first lower overlay sheet having a substantially smaller perimeter than said base sheet and adhered concentrically and conformally to the upper, impact surface of said base sheet, and (c) a second, upper overlay sheet of thin woven synthetic plastic material, said second, upper overlay sheet adhered congruently and conformally to the upper surface of said first, lower overlay sheet, concentrically within the perimeter of said lower overlay sheet, the woof directions of said first and second sheets being oriented at ninety degrees with respect to one another.

19. The head of claim 18 wherein at least the upper surface of at least the upper of said first and second overlay sheets is coated with a synthetic plastic material.

20. The head of claim 21 wherein said first and second overlay sheets are fabricated from polyester fibers.

21. The head of claim 20 wherein said synthetic plastic material coating the upper surface of said second, upper overlay sheet is further defined as being a vinyl compound.

22. The head of claim 21 wherein said first and second overlay sheets are further defined as each having an approximate weight of 2.8 ounces per square yard.

23. The head of claim 20 wherein said first and second overlay sheets are further defined as having a thickness of approximately 0.004 inch to 0.007 inch.

24. The head of claim 20 wherein said first and second overlay sheets are further defined as having a circular outline.

25. The head of claim 19 wherein said base sheet is fabricated from a biaxially stretched, synthetic plastic film.

26. The head of claim 25 wherein said synthetic plastic film is further defined as being composed of a condensation polymer of ethylene glycol and terephthalic acid.

27. The head of claim 26 wherein said synthetic plastic film is further defined as having a thickness of approximately 0.006 inch to 0.015 inch.

* * * * *